United States Patent [19]

Koda

[11] 4,445,304

[45] May 1, 1984

[54] METHOD AND APPARATUS FOR SUPPORTING A VERTICAL CYLINDER OF WET CEMENT SURROUNDING A VERTICAL PIPE PASSING THROUGH A HORIZONTAL CONCRETE SLAB

[76] Inventor: Andrew Koda, 1238 14th Ave. N., Naples, Fla. 33940

[21] Appl. No.: 245,267

[22] Filed: Mar. 19, 1981

[51] Int. Cl.[3] ..... E04B 5/48; E04F 17/08; E04G 23/00

[52] U.S. Cl. ..... 52/127.3; 52/221; 52/741; 249/83; 249/97

[58] Field of Search ..... 249/83, 90, 91, 93, 249/94, 95, 96, 97, 175, 177, 186, DIG. 3, 89; 52/85, 214, 514, 221, 127.3, 741; 285/189

[56] References Cited

U.S. PATENT DOCUMENTS

| | | | |
|---|---|---|---|
| 931,213 | 8/1909 | McElvain | 285/189 |
| 994,200 | 6/1911 | Riker | 249/186 |
| 1,237,003 | 8/1917 | Weston | 249/89 |
| 1,342,918 | 6/1920 | Legg | 52/219 |
| 1,482,565 | 2/1924 | Johnson et al. | 249/83 |
| 1,651,269 | 11/1927 | Gnagi | 52/741 |
| 2,671,261 | 3/1954 | Mitchell | 249/96 |
| 2,753,962 | 7/1956 | McBerty | 52/93 |
| 3,008,273 | 11/1961 | Widin | 52/85 |
| 3,265,349 | 8/1966 | Hamrick | 249/177 |
| 3,973,366 | 8/1976 | Balane et al. | 52/221 |

*Primary Examiner*—Alfred C. Perham
*Attorney, Agent, or Firm*—Merrill N. Johnson

[57] ABSTRACT

A novel method and apparatus for supporting a vertical cylinder of wet cement surrounding a verticle pipe passing through a horizontal concrete slab in which one leg of an L-shaped piece is wrapped around the vertical pipe just below the slab and the other leg of the L-shaped piece is slit to form a series of slats which radiate horizontally around the pipe. A circular sheet of moisture resistant material having a hole in its center corresponding to the diameter of the pipe and slit from its center to its outer edge is slipped around the pipe just above the slats of the L-shaped piece, which is then pushed upwards on the pipe to press the sheet against the lower surface of the concrete slab. The piece and sheet are secured in position by a wire wrapped and twisted about the leg of the piece wrapped around the pipe. Wet cement can now be poured from above into the void between the pipe and the slab to be supported during its drying by the sheet and piece. The piece used is cut from an elongated strip having one leg formed into a series of parallel slats, which strip is a part of my invention.

4 Claims, 4 Drawing Figures

METHOD AND APPARATUS FOR SUPPORTING A VERTICAL CYLINDER OF WET CEMENT SURROUNDING A VERTICAL PIPE PASSING THROUGH A HORIZONTAL CONCRETE SLAB

BRIEF SUMMARY OF THE INVENTION

In the construction of high rise buildings, each horizontal concrete slab forming a floor contains a large number of cylindrical holes cast into the slab to permit the installation of vertical pipes of varying size carrying water, gas, electricity and sewage to or from each floor. Usually the hole is cast with a diameter about two inches or more larger than the diameter of the pipe to permit positioning the pipe.

After the pipes have been installed, and often after wall-support members have been installed around the vertical pipes, it is necessary to comply with building codes to fill in the void between each pipe and the surrounding slab with wet cement.

Up to now, to support the wet cement while drying, a carpenter would cut identical semi-circles along one edge of two square or rectangular blocks of plywood, the semi-circles having a diameter just larger than the diameter of the pipe. The two matching blocks of plywood are then fitted around the pipe and each block nailed to the lower face of the slab. The two blocks thus form a support for the wet cement poured in from above to fill the void between the pipe and the slab.

However, this method of supporting the wet cement requires about 30 or more minutes time of a skilled carpenter and is both costly and awkward, especially when wall supporting members along the ceiling interfere with accessibility to and space for placing the plywood blocks around the pipe.

I have invented an improved method and apparatus for supporting the wet cement. I start with an elongated strip of galvanized sheet metal or suitable plastic bent into an L-shape and containing along one leg of the strip a series of parallel slits running from the edge to the center of the strip and spaced ½ to one inch apart to form a series of slats. The other leg of the strip contains a series of two short parallel slits about ⅜ths of an inch apart, each pair of slits spaced about 4 inches apart. Conveniently each strip should be about 36 inches long or somewhat longer.

If, for example, a support is needed for the void surrounding a pipe having a diameter of 2 inches, I cut off from the strip a piece having a length equal to the circumference of the pipe or about 6¼ inches and wrap this piece around the pipe beneath the slab, using a piece of wire to hold the strip around the pipe.

A support for the wire is formed by bending upward one or more of the small tabs formed by the short parallel slits in the leg wrapped around the pipe. By wrapping the one leg of the strip about the pipe, the slats of the other leg will spread apart like the spokes of a wheel radiating from the pipe.

I then cut a piece of tarpaper or suitable moisture resistant plastic into a circle with a hole in its center having a diameter just slightly larger than the pipe and a slit from the hole to the outer edge of the tarpaper circle. This circle is slipped around the pipe and the piece shoved upward on the pipe to press the tarpaper circle against the lower surface of the concrete slab, thereby forming a secure support for the wet cement poured in from above to fill the void between the pipe and the slab.

The foregoing method and apparatus has been successfully used to markedly reduce the time and expense of filling the voids between vertical pipes and the concrete slabs of several high rise buildings under construction in Florida.

DETAILED DESCRIPTION

In order to practice my novel method of filling in the void between a vertical pipe and a surrounding horizontal slab, I first construct a novel piece of apparatus from a conventional metal or plastic strip.

Figure 1:
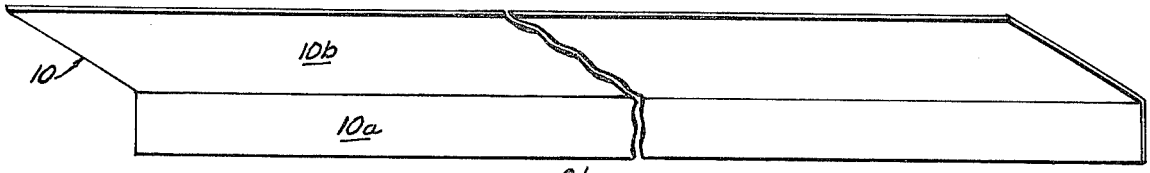
FIG. 1 is a perspective view of a conventional metal strip used to form a strip according to my invention.

FIG. 1 shows one such conventional strip 10 which is formed from a sheet of galvanized steel about 36 inches long and 5 inches wide and bent 90° along a line parallel to its longer dimension to form one leg **10*a* with a width of 1½ inches and the other leg 10*b*** with a width of 3½ inches. Such strips in varying sizes are commonly used in the construction industry.

Figure 2:
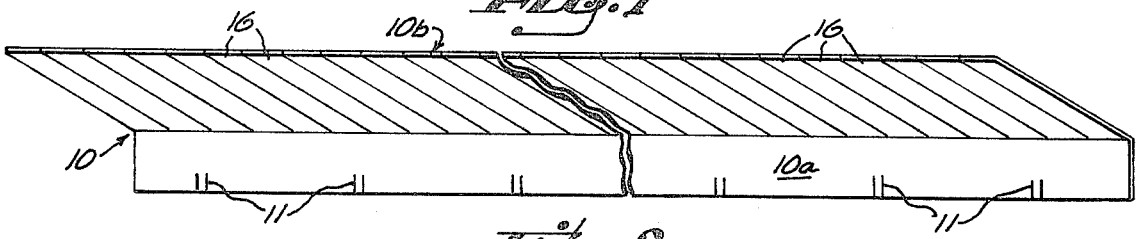
FIG. 2 is a similar view of a strip made according to my invention.

FIG. 2 shows strip 10 modified according to my invention. Leg **10*a* now contains a series of two short parallel slits about ⅜ths of an inch long and ¼th inch apart, the pairs of slits spaced about 4 inches apart. Each pair of slits forms a bendable tab 1⅜th of an inch long and ¼ inch wide as shown in FIGS. 2, 3 and 4**.

Leg **10*b* of strip 10 now contains a series of parallel slits spaced about ¾ inch apart running from one edge of this leg to the other, thus forming leg 10*b* into a series of ¾ by 3½ inch slats 16 attached to each other by leg 10*a***.

Figure 3:
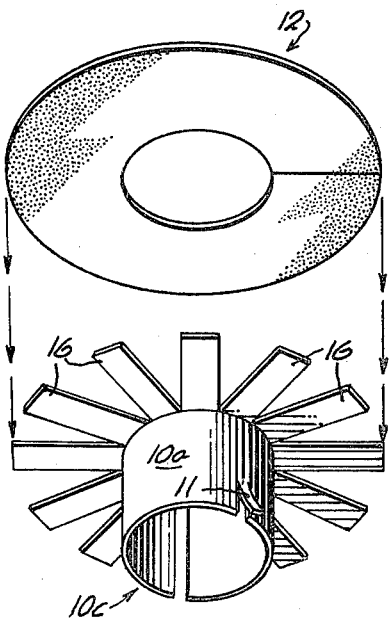
FIG. 3 is a perspective view of a piece cut from the strip shown in FIG. 2 and bent to surround a pipe together with a circular sheet to be used with the bent piece to support a column of wet cement.
Figure 4:
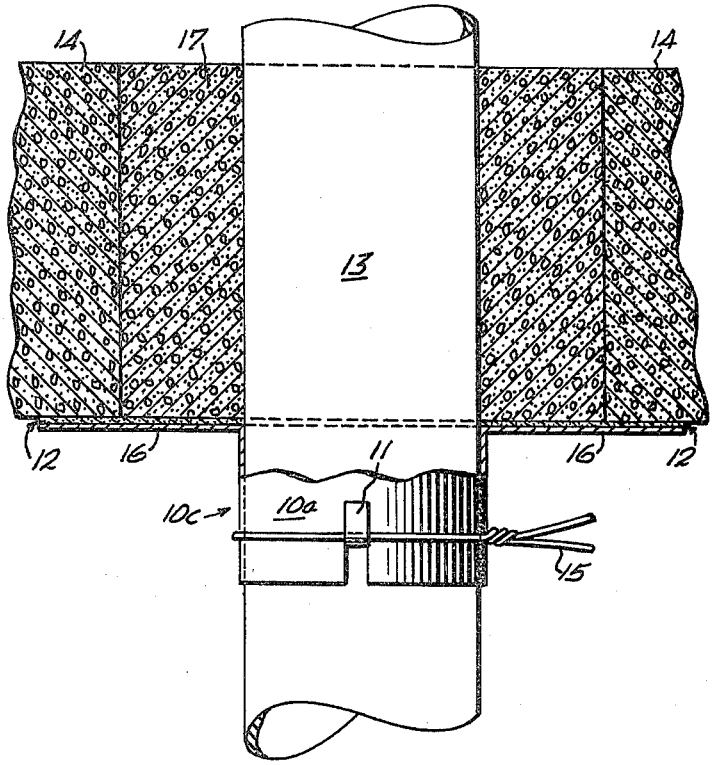
FIG. 4 is a side view partially in crosssection showing a vertical pipe passing through a hole in a horizontal concrete slab and a piece and circular sheet as shown in FIG. 3 mounted on said pipe and supporting a column of wet cement surrounding the pipe.

FIGS. 3 and 4 illustrate how my novel method and apparatus are used. FIG. 3 shows how a piece shown as **10*c* cut off from strip 10 is bent to wrap around a vertical pipe. FIG. 3 also shows a circular sheet of moisture resistant material such as tarpaper or plastic cut into a circle with a hole in its center having a diameter just slightly larger than the pipe which it is to surround and slit from its center to its outer edge. The outer diameter of sheet 12** is preferably about two inches greater that the hole in the slab surrounding the vertical pipe.

FIG. 4 illustrates a typical use of my method and apparatus in which a vertical pipe 13 passes through a cylindrical hole in horizontal slab 14 shown in cross section. If pipe 13 has an outside diameter of 3 inches and thus a circumference of about 9½ inches, a piece **10*c* having a length about 9 inches is cut from strip 10. One or more of tabs 11 in leg 10*a* are bent outwardly as best shown in FIG. 3 and then leg 10*a* of piece 10*c* is bent into the shape shown in FIG. 3 and wrapped around pipe 13 and held loosely about the pipe by a wire 15 which is positioned by bending tab 11** upwardly about the wire.

Sheet 12 is now slipped about pipe 13 just above piece 10*c* and then piece 10*c* is pushed upwardly so that sheet 12 is firmly pressed against the lower surface of slab 14.

As leg 10*a* is bent into a circle and wrapped around a pipe, slats 16 of piece 10*c* spread out like the spokes of a wheel radiating from the pipe to provide a firm support for sheet 12.

With sheet 12 firmly pressed against slab 14, wire 15 is twisted tightly about leg 10*a* to hold piece 10*c* and sheet 12 in place.

Wet cement 17 can now be poured from above into the void between pipe 13 and slab 14 to be supported while the cement dries by sheet 12 and piece 10*c* in accordance with my invention.

Use of the foregoing method and apparatus results in considerable economies in the construction of high rise buildings which often have a thousand or more cast holes in their horizontal slabs which, in conformity with building codes and engineering practice, must be filled. The conventional method described requires employment of a skilled carpenter and often takes 30 minutes or more. In contrast, my method and apparatus can be performed entirely by unskilled labor and usually takes only five minutes per hole.

Having disclosed a preferred embodiment of my invention, those skilled in the art will be able to modify certain aspects of my method and apparatus while still utilizing the principles of my invention and it is therefore intended that all such modifications be covered as they are embraced within the scope of the appended claims.

I claim:

1. A method of filling the space between a vertical pipe and a horizontal concrete slab with wet cement, comprising wrapping one leg of an L shaped piece around the vertical pipe just below the slab, the other leg of the piece being slit to form a series of slats radiating horizontally around the pipe, slipping a circular sheet of flexible moisture resistant material about the pipe just above the slats of the piece, pushing the piece upwardly on the pipe so as to press the sheet firmly against the lower face of the slab, securing the sheet and piece in position, and then pouring wet cement into the space between the pipe and the slab, which wet cement is supported while drying by the sheet and L-shaped piece.

2. The method of claim 1 wherein the L-shaped piece is secured in position by a wire twisted around the leg of the piece wrapped around the pipe.

3. Apparatus for supporting a vertical cylinder of wet cement surrounding a vertical pipe passing through a horizontal concrete slab, comprising an L-shaped piece having a first leg adapted to be wrapped around the vertical pipe and a second leg at 90° to the first leg slit into a series of parallel slats which, when the first leg is wrapped around a pipe, will radiate outwardly from the pipe like the spokes of a wheel, and a circular sheet of flexible moisture resistant material having a hole in its center of the same diameter as the pipe and a slit from its center to its outer edge.

4. The apparatus of claim 3 wherein the leg of the L-shaped piece to be wrapped around the vertical pipe contains one or more vertical tabs adapted to be bent upwardly to support a wire positioned around said leg.

* * * * *